US006330984B1

(12) United States Patent
Barker et al.

(10) Patent No.: US 6,330,984 B1
(45) Date of Patent: Dec. 18, 2001

(54) METHOD AND APPARATUS FOR STORING STRIP MATERIAL

(75) Inventors: Brandy Cyan Barker, Akron; Donald Chester Kubinski, Medina, both of OH (US); Rodney Taylor Moffatt, Ontario (CA); Christopher David Dyrlund, Akron, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/475,339

(22) Filed: Dec. 30, 1999

(51) Int. Cl.[7] ..... B65H 18/08
(52) U.S. Cl. ..... 242/536
(58) Field of Search ..... 242/548, 548.2, 242/615.2, 615.4, 536, 530.2, 602.3; 226/88

(56) References Cited

U.S. PATENT DOCUMENTS

| | | | | |
|---|---|---|---|---|
| 3,102,700 | | 9/1963 | Lemieux, Jr. | 242/62 |
| 3,549,101 | * | 12/1970 | Krause | 242/76 |
| 3,795,370 | * | 3/1974 | Dean | 242/67.1 |
| 3,979,079 | | 9/1976 | Ohashi et al. | 242/75.2 |
| 4,171,107 | * | 10/1979 | Kayser et al. | 242/67.1 R |
| 4,667,863 | | 5/1987 | Brunner et al. | 226/1 |
| 4,893,740 | | 1/1990 | Hediger et al. | 226/23 |
| 5,641,132 | | 6/1997 | Bardy | 242/536 |
| 5,833,171 | | 11/1998 | Harris | 242/615.1 |
| 5,921,057 | * | 7/1999 | Alderman et al. | 52/746.11 |

FOREIGN PATENT DOCUMENTS

| | | | |
|---|---|---|---|
| 0 621 124 A1 | 4/1994 | (EP) | B29D/30/52 |
| 111261-1986 | 5/1986 | (JP) | B65H/18/08 |
| WO 98/19949 | 5/1998 | (WO) | B65H/27/00 |
| WO 98/33734 | 8/1998 | (WO) | B65H/27/00 |

* cited by examiner

*Primary Examiner*—Donald P. Walsh
*Assistant Examiner*—Mark J. Beauchaine
(74) *Attorney, Agent, or Firm*—Nancy T. Krawczyk

(57) ABSTRACT

The present invention is directed towards an improved method for delivering a continuous strip material to a spool upon which it is to be wound. The method includes the step of reducing the effective width of the continuous strip material prior to its being wound on the spool by shaping the strip material into an arcuate cross-section. The shaping means is rotatable about an axis parallel with the axis of the spool. The method includes moving the shaping means axis of rotation while winding the strip material on the spool and maintaining the shaping means axis of rotation parallel with the spool.

4 Claims, 8 Drawing Sheets

METHOD AND APPARATUS FOR STORING STRIP MATERIAL

FIELD OF THE INVENTION

The present invention is directed toward a method and apparatus for storing strip material. More specifically, the present invention is directed towards a method and apparatus for positioning a continuous strip of material onto a spool.

BACKGROUND OF THE INVENTION

The present discussion is directed specifically towards the manufacture of strip material for building tires; however, the background art and the disclosed invention may also be applicable to other types of manufacturing wherein it is necessary to store strip material.

When forming a strip component, it may be desired to store the component in a manner that prevents the destruction or alteration of any preformed cross-sectional configuration. This is frequently accomplished by storing the component in a spiral spool storage device. The component is placed on a liner that is spirally wound inside the spool. Spacing between adjacent rows of spirally wound liner prevents the adjacent layers of wound material from contacting, thus preserving the preformed cross-sectional configuration of the strip component.

U.S. Pat. No. 5,412,132, JP 61-111261, and EP 621,124 illustrate such storage devices. U.S. Pat. No. 5,641,132 discloses a spool with stepped flanges wherein a liner of increasing width rests on the stepped flanges to support the component within the spool storage device. JP 61-111261 discloses a spool formed with protrusions for the edges of a liner to rest upon. EP 621,124 discloses a spiral spool storage device wherein the edges of the liner rest in continuous spiral grooves formed on the inner face of the spool flanges.

Because the space provided for the edges of the liner are of a relatively small dimension, the liner must be precisely fed to the storage spool. JP 61-111261 discloses first feeding the liner through a fixed metal plate. The plate has an arcuate shape with flanged sides causing the plate to have a width less than the width of the liner. The liner is fed through the plate, inside the flanges, reducing the effective width of the liner. After the liner passes through the plate, the liner is feed onto the spool. The liner returns to its original width after once it is placed onto the spool, known in the art as the liner "popping" into place.

EP 621,124 also teaches reducing the effective width of the liner prior to feeding it into position on the spiral spool. Three different methods of reducing the liner width are disclosed. Two methods employ the use of curved bars through which the liner passes. The curved bars are in a fixed angular relationship with the rod upon which the bars are attached. The third method disclosed employs two pairs of deflecting bars. The first pair initially deflects the edges of the liner and the second pair slides relative to the spiral spool to ensure proper positioning of the liner onto the spool.

While the above methods accomplish the goal of delivering the liner to the spiral spool, these methods require precise placement of the liner to prevent the liner from popping out of place, and to prevent folding and creasing. When such problems do occur with the liner, the continuous manufacturing of the component must be stopped to resolve the problem. The present invention is directed to a method of delivering the liner to the spiral spool in a manner and by an apparatus which overcomes these limitations and issues of the known delivery systems.

SUMMARY OF THE INVENTION

The present invention is directed towards an improved method for delivering a continuous strip material to a spool upon which it is to be wound. The method includes the step of reducing the effective width of the continuous strip material prior to its being wound on the spool by shaping the strip material into an arcuate cross-section. The shaping means is rotatable about an axis parallel with the axis of the spool. The method includes moving the shaping means axis of rotation while winding the strip material on the spool and maintaining the shaping means axis of rotation parallel with the spool.

A further aspect of the invention includes moving the shaping means axis of rotation in a vertical direction.

In another aspect of the invention, the shaping means includes multiple sets of rollers that interact to reduce the effective width of the strip material. The shaping means may also be defined by a fully enclosed slot, which maintains the reduced effective width of the strip material.

BRIEF DESCRIPTION OF THE DRAWINGS

The invention will be described by way of example and with reference to the accompanying drawings in which.

DETAILED DESCRIPTION OF THE PREFERRED EMBODIMENTS

Figure 1:
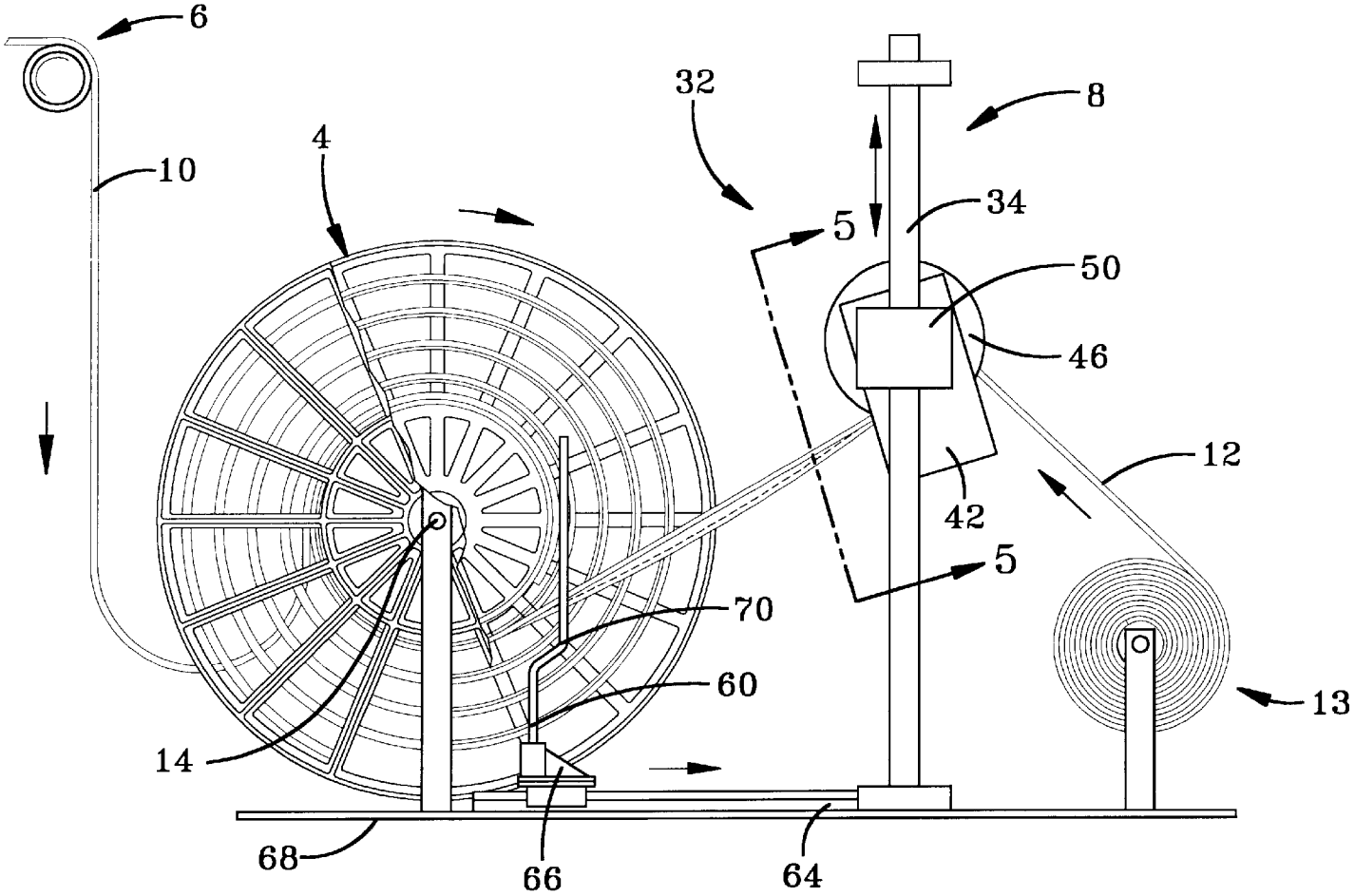
FIG. 1 illustrates an apparatus for winding a strip component.

With reference to FIG. 1, an apparatus, incorporating the present invention, for winding and storing a strip component is illustrated. The apparatus is comprised of a spool 4 in which the strip component 10 is wound, a let-off means 6 for the strip component 10, and a delivery system 8 for the liner 12 upon which the strip component 10 is to be placed. The spool 4 is mounted on an axle 14 coincident with the axis of the spool 4 and upon which the spool 4 rotates. As the spool 4 rotates, the liner 12 is fed from one side of the spool 4 from a liner spool 13, while the strip component 10 is then laid upon the liner 12 from the other side of the spool 4. The strip component 10 can be unvulcanized elements of a tire, such as sidewalls, tread, apex, or other strip materials that could be susceptible to crushing in conventional storage mechanisms.

Figure 3:
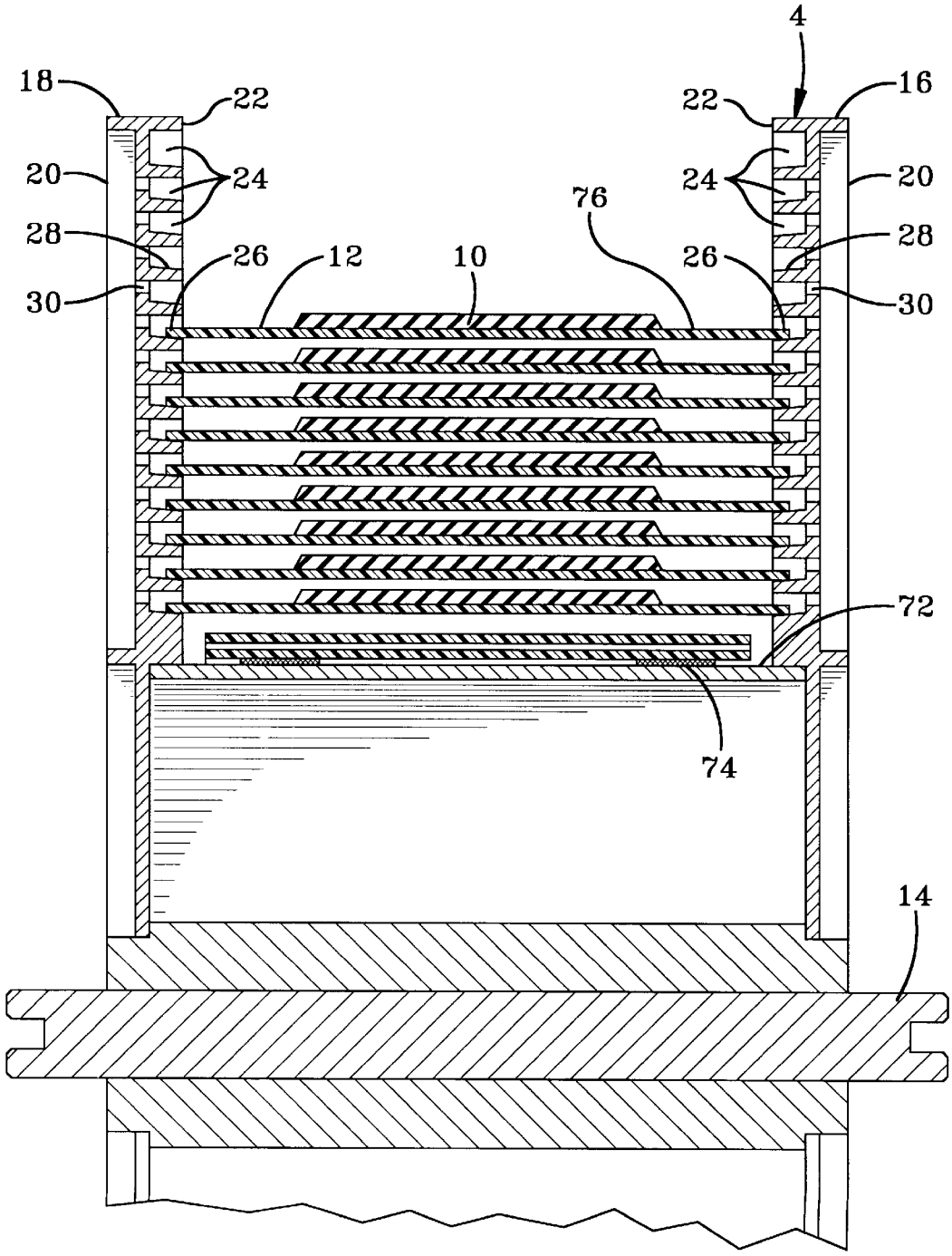
FIG. 3 is a cross-sectional view of the spiral spool along line 3—3 of FIG. 2.
Figure 4:
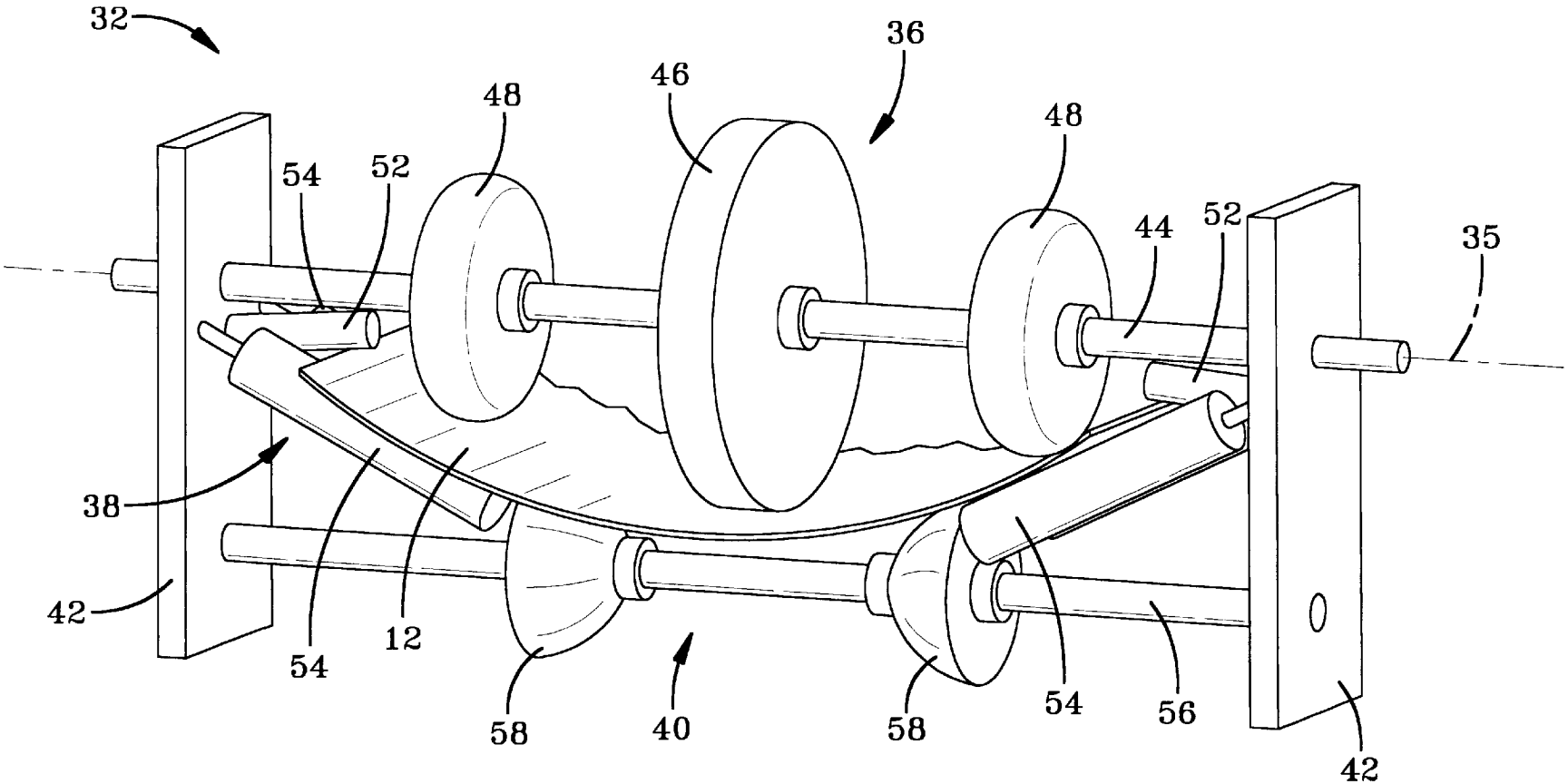
FIG. 4 is a perspective view of the pre-former.
Figure 4A:
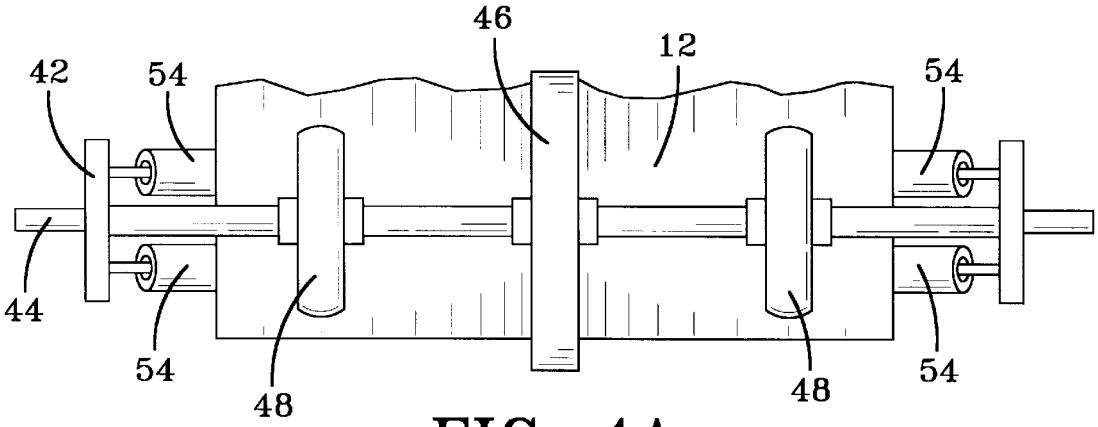
FIG. 4A is a top view of the pre-former.
Figure 4B:
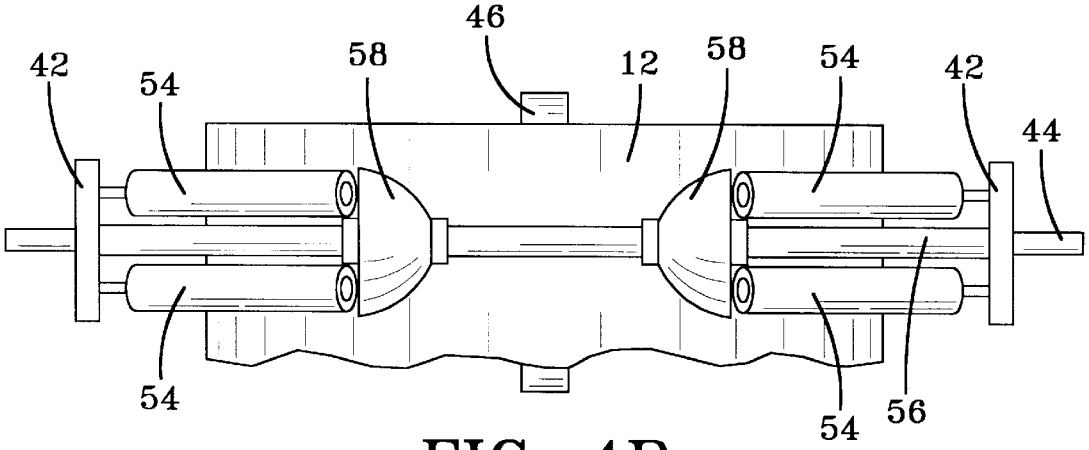
FIG. 4B is a bottom view of the pre-former.
Figure 5:
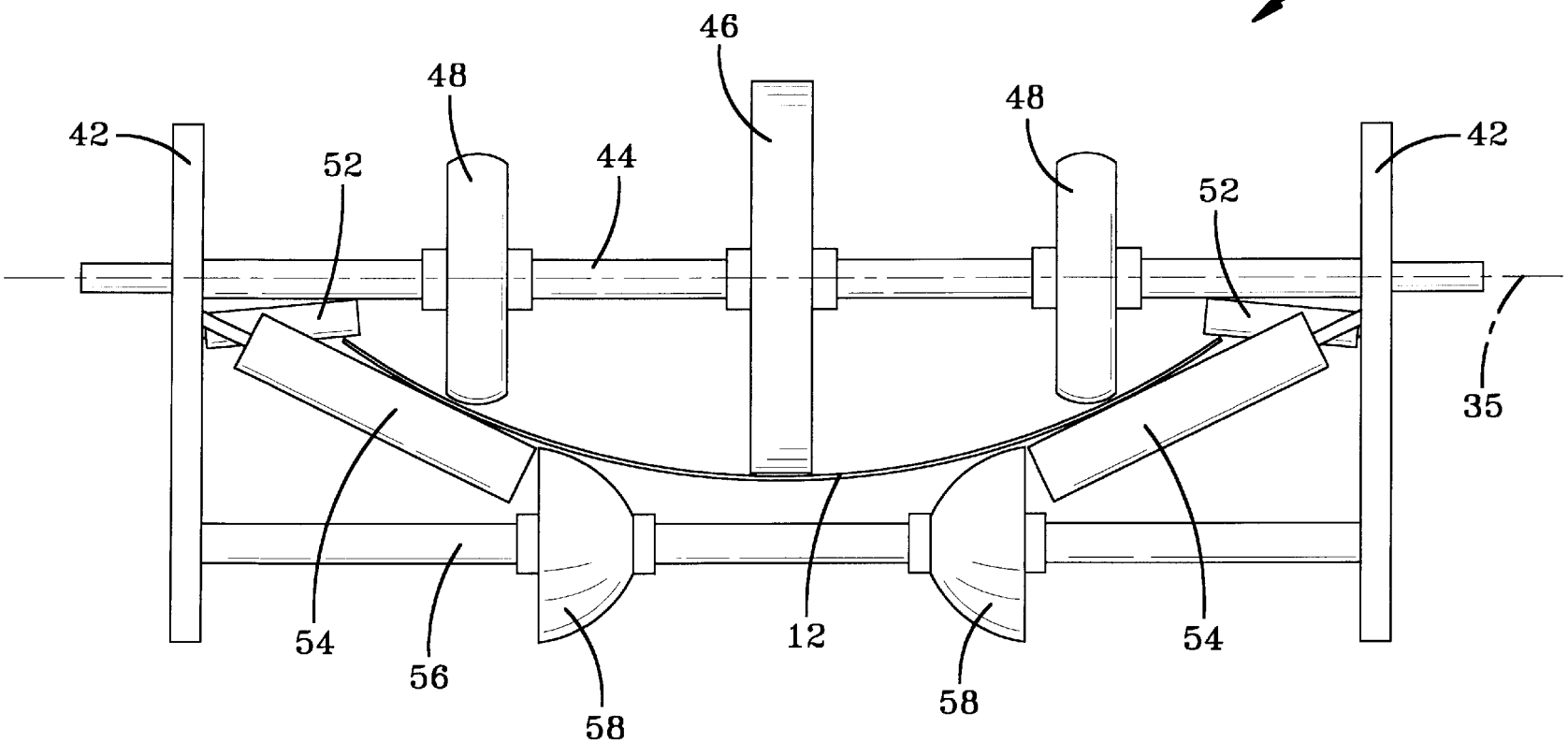
FIG. 5 illustrates the pre-former.

The spool 4 has first and second flanges 16, 18, see FIG. 3. Each of the flanges 16, 18 has an axially outer surface 20 and an axially inner surface 22. The axially inner surfaces 22 of the first and second flanges 16, 18 each have a continuous spiral groove 24. The grooves 24 are adapted to receive the edges 26 of the liner 12. The grooves 24 have a radius creating a radial distance between the adjacent turns of each groove 24 that is greater than the combined thickness of the liner 12 and the strip component 10 to be wound into the spool. The radially inner surface 28 of each groove 24 is beveled downwards toward the central axis of the spool 4. In a preferred construction, the radially inward surface 28 is beveled so that it makes an angle of about 10° with a line parallel to the axis of the spool 4. The purpose of the beveling is to facilitate insertion and removal of the liner edges 26.

The liner 12 has a sufficient width to extend between the spool flanges 16, 18 and permit the liner edges 26 to rest within the spiral grooves 24. The liner 12 must be formed of a strong enough material so that the weight of the strip component 10, when wound into the spool 4, does not cause the liner 12 to deflect and contact or crush the component 10 stored upon radially inner windings of the component 10 and liner 12. Preferred materials for the liner 12 include rigid polyethylene terephthalate, polypropylene, and other similar materials.

Figure 2:
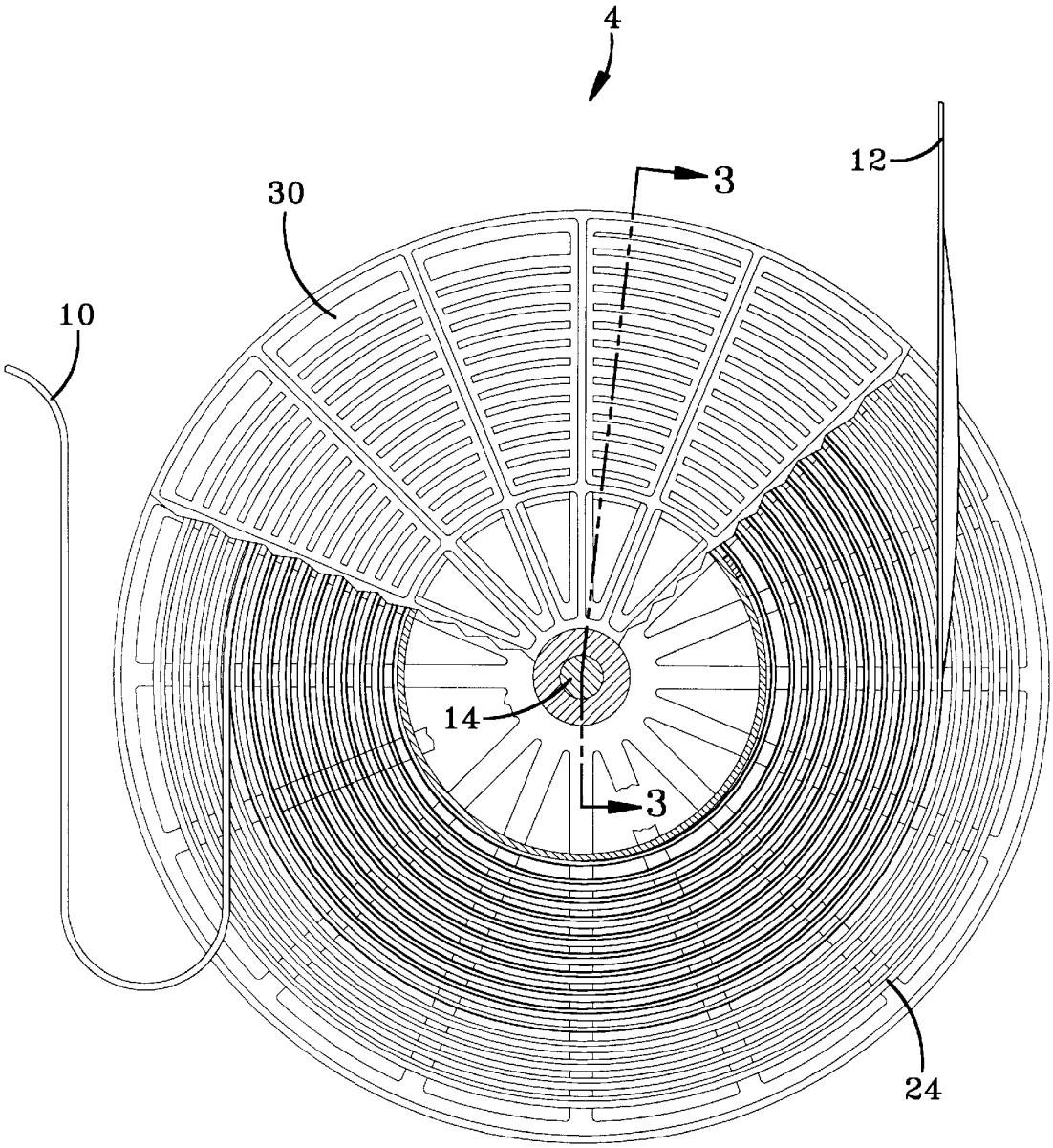
FIG. 2 illustrates the spiral spool as the strip component and liner are being wound thereon.

The spool 4 is also defined by a series of openings 30 in the axially outer surfaces 20 of the flanges 16, 18, see FIG. 2. Because the strip component 10 is preferably loaded onto the spool 4 directly from an extruder, it is still hot and in various stages of curing. The openings 30 of the spool 4 permits air to flow back and forth through the openings 30 and over the strip component 10.

As previously discussed, for proper delivery of the liner 12 to the spool 4, it is desired to reduce the effective width of the liner 12, i.e. shaping the liner 12 into an arcuate cross-sectional configuration. This is accomplished within the liner delivery system 8 which incorporates a pre-former 32 mounted on a pair of Thomson rails 34; the Thomson rails 34 permit the pre-former 32 to travel vertically. The pre-former 32 is mounted to the Thomson rails 34 by means of the bearing box 50. The bearing box 50 is provided with an internal bushing. The bushing allows the pre-former 32 to pivot freely about a longitudinal axis 35, enabling the pre-former 32 to remain in a perpendicular alignment to the liner 12 as the liner 12 passes through the pre-former 32. The pre-former 32 is the shaping means which shapes the liner 12 into the desired arcuate cross-sectional configuration.

In one embodiment, the pre-former 32 has three sets of interacting rolls 36, 38, 40 mounted on end frames 42, see FIGS. 4, 4A, 4B, 5. The sets of rolls 36, 38, 40 interact to shape the liner 12 to a desired curved configuration prior to insertion of the liner 12 in the spool 4. The first set of rolls 36 can be defined as upper deflection rolls, the second set of rolls 38 are edge deflection rolls, and the third set of rolls 40 can be defined as underside support rolls.

The set of upper deflection rolls 36 is mounted on an axle 44 and has at least two different sized rolls 46, 48. A center roll 46 has the greater relative diameter and two smaller diameter rolls 48 are mounted on the axle 44 at equi-distances from the center roll 46. The rolls 46, 48 are mounted on bearings to rotate about the axle 44. The axle 44 through each end frame 42 and into a bear box 50. The axle 44 rests in the internal bushing of the bearing box 50. This configuration of the set of upper deflection rolls 36, in conjunction with the second and third set of rolls 38, 40, bows the bows the liner 12 as it passes beneath the set of deflection rolls 36, reducing the effective width of the liner 12.

There are two sets of edge deflection rolls 38, one set 38 attached to each end frame 42. Each set of edge deflection rolls 38 is preferably comprised of two different sized rolls 52, 54. There is a single short center roll 52 and two long outer rolls 54. The center roll 52 is aligned with the axle 44 of the first set of rolls 36, and is preferably inclined at an angle relative to the axle 44. The long rolls 54 extend at an angle relative to the axle 44 of the first set of rolls 36, in an opposing direction from the short roll 52, and are attached to the associated end frame 42 adjacent the short roll 52. The rolls 52, 54 are mounted on bearings so that each roll 52, 54 may rotate along its longitudinal axis as the liner passes through the pre-former. The short rolls 52 restrain the vertical and horizontal movement of the liner edges 26 and the long rolls 54 support the liner 12 from underneath to maintain the arcuate liner configuration.

The set of underside support rolls 40 is mounted on an axle 56 extending between the end frames 42. The set 40 is comprised of two identical rolls 58 equi-spaced from the centerpoint of the axle 56. The axle 56 is mounted on the same long axis of the end frames 42 as the first set axle 44. The rolls 58 have a conoid configuration, wherein the greatest diameter of the rolls 58 faces the end frames 42. The rolls 58 are mounted on bearings to permit rotation about the axle 56. Preferably, to provide consistent support for the liner 12, the outer surface of the rolls 58 are directly adjacent to the outer surface of the long rolls 54 of the second sets 38. If needed, a small roll may be mounted centrally between the two rolls 58 to support the underside of the centermost point of the liner 12.

It would be appreciated by those in the art that while a particular roll combination and construction has been disclosed, other roll may be substituted for the disclosed rolls so long as a desired trough shaped path is maintained for the liner 12 to travel through when passing through the pre-former 32.

Figure 6:
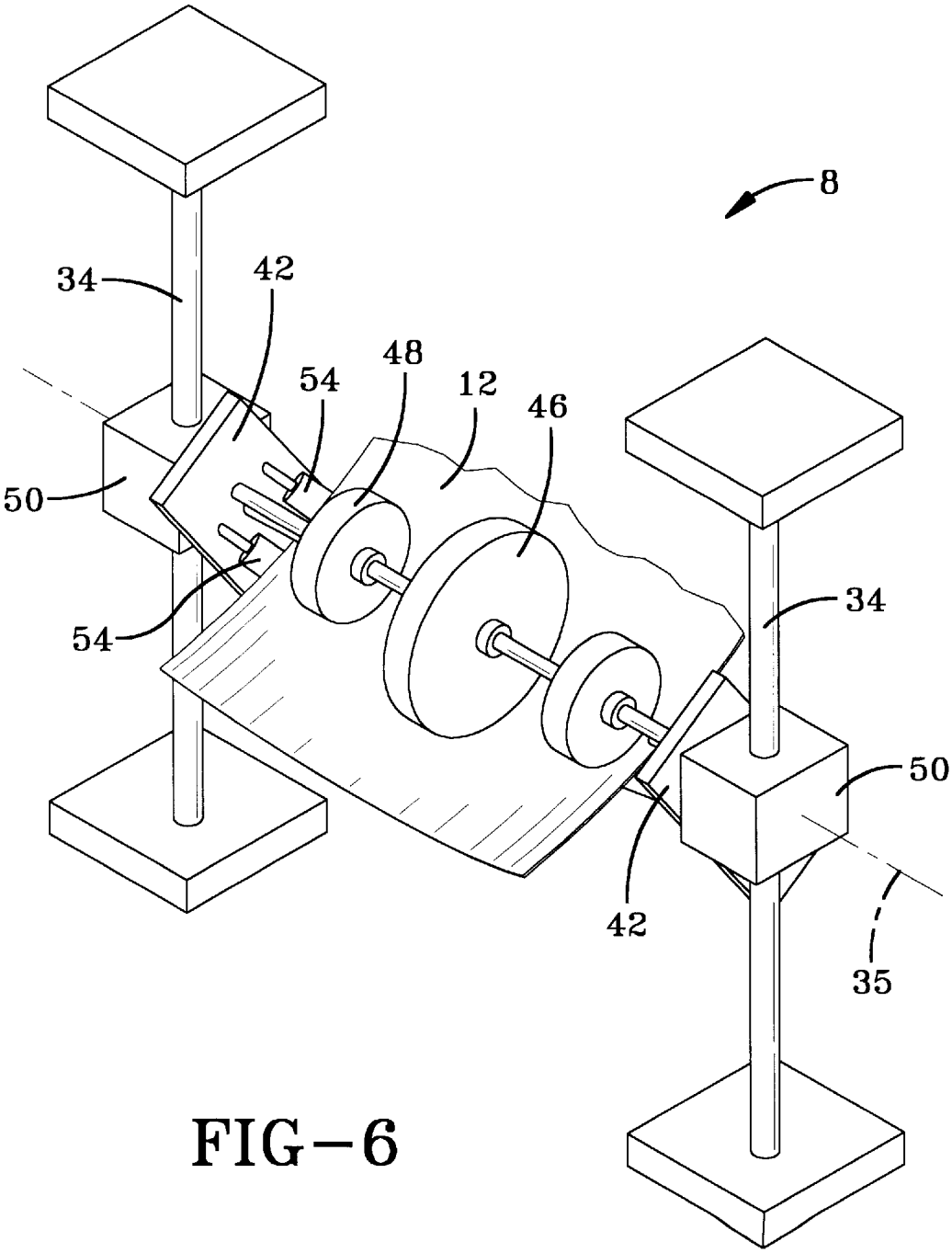
FIG. 6 illustrates the liner delivery system.

As noted above, axle 44 extends through the end frames 42 and into a bearing box. The bearing box permits the pre-former 32 to pivot about the longitudinal axis 35 of the axle 44, see FIGS. 1 and 6, as the pre-former 32 travels up and down the Thomson rails 34. The bearing box 50 is provided with an internal bushing. The axle 44 rests in the bushing. The bushing allows the axle 44 to freely pivot about the longitudinal axis 35 of the axle 44, enabling the pre-former 32 to remain in a perpendicular alignment to the liner 12 as the liner 12 passes through the pre-former 32. It is the stiffness of the liner 12 as it passes through the pre-former 32 that causes the pre-former 32 to pivot. The pre-former 32 also travels the Thomson rails 34 in order to maintain alignment of the liner 12 coming out of the pre-former 32 with the location where the liner 12 is fed onto the spool 4. This permits a smoother transition of the liner 12 from the liner spool 13 to the storage spool 4. Thus, during operation of the liner delivery system 8, the pre-former 32 moves in two different directions about two different planes. The pre-former 32 rotates about a single axis 35, parallel to the axis of the spool 4, and travels vertically along the Thomson rails 34. It is this combination of movement that maintains the liner 12 in the desired delivery configuration and orientation to the spool 4, and permits the liner 12 to be properly delivered into the storage spool 4.

Adjacent to the spool 4 is a set of deflecting bars 60 mounted on a sliding platform 62. The sliding platform 66 is translatable along a rail 64 that is mounted to a base 68 of a frame upon which the spool 4 is mounted. The deflecting bars 60 have a bend 70 near their midpoint that is designed to accommodate the limitations of existing equipment. Should new spools, frames, and let-offs be configured to implement the apparatus, this bend 70 will no longer be necessary. The purpose of the sliding platform 62 is to adjust the deflecting qualities of the deflecting bars 60 as the spool 4 fills with liner 12 and strip component 10. When the spool 4 is nearly empty, the deflecting bars 60 are fairly close to the axle of the spool 4. As the spool 4 rotates and becomes filled with liner 12 and strip component 10, the deflecting bars 60 slide radially outwardly away from the axis of the spool 4.

With reference to FIGS 1 and 3, the method by which the liner 12 and strip component 10 is loaded onto the spool 4 will be described. When the spool 4 is empty and being prepared for storing strip material 10, about one revolution of the end of the liner 12 is wrapped around the core 72 of the spool 4 and secured thereto by means such as hook and loop strips 74. The edges of the liner 26 are initially threaded into the first opening of the groove 24. Once the liner 12 has been correctly threaded into the groove 24, it follows the spiral pattern of the groove 24 and thus continues to be threaded into the entire spool 4 as the liner edges 26 are pulled into the groove 24. As the spool 4 rotates 180°, a newly extruded strip of strip component 10 is laid on the radially outward surface 76 of the liner 12. The process continues with the spool 4 rotating and loading liner 12 and strip component 10 into the spool 4 in a spiral fashion until the spool 4 is full.

Figure 7:
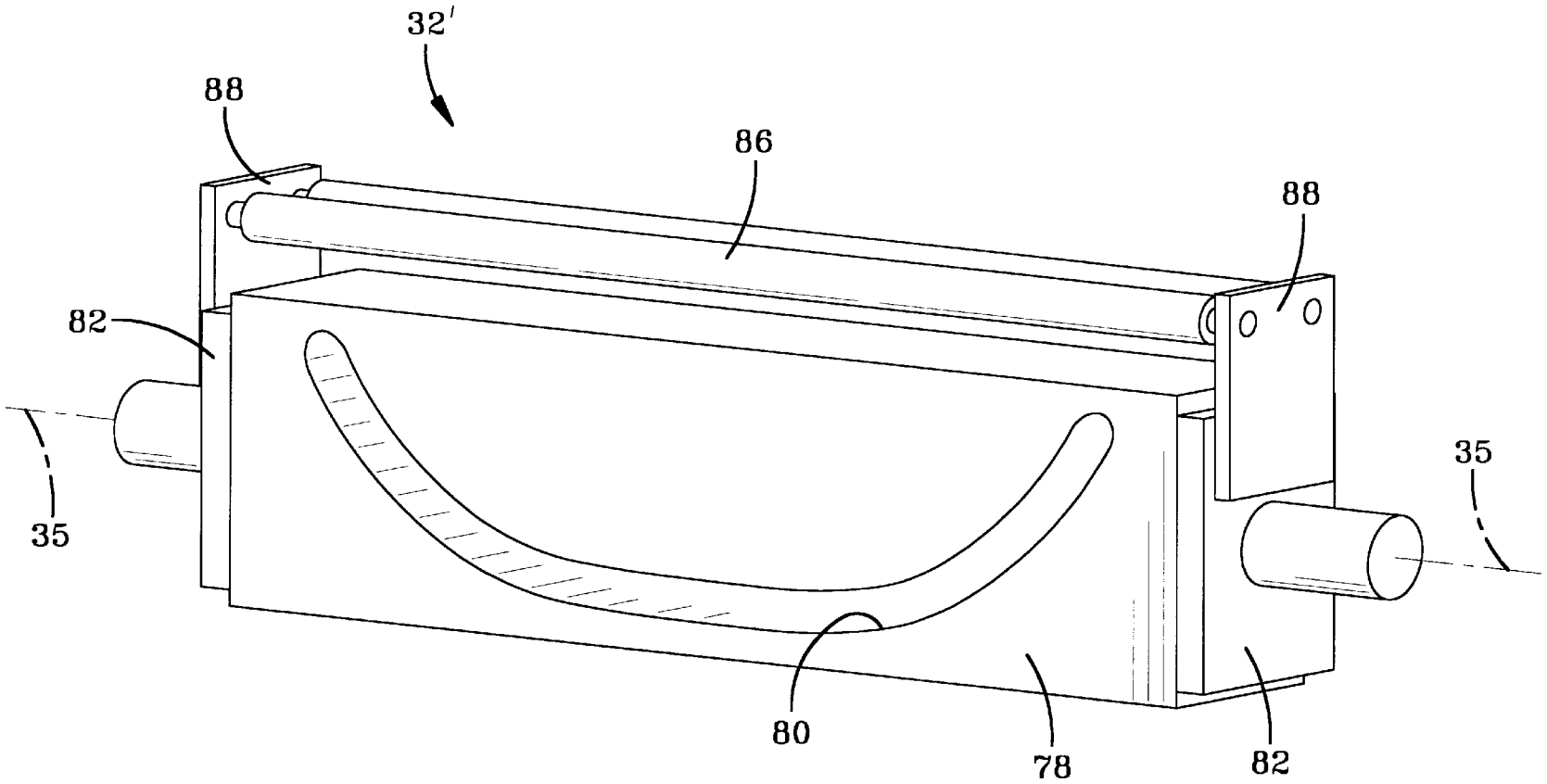
FIG. 7 illustrates a second embodiment of the pre-former.

An alternative embodiment of the pre-former 32' is illustrated in FIG. 7. The pre-former 32' is formed from a single block 78 of lightweight material. A slot 80 corresponding to the desired curvature, i.e. reduced effective width, of the liner 12 is cut into the block 78. Mountings 82 are provided at each end of the block 78 so that the pre-former 32' may be attached to the bearing boxes 50. The pre-former 32' operates similar to pre-former 32, in that, due to the internal bushings in the bearing boxes 50, the pre-former 32' may rotate about a longitudinal axis 35, parallel to the axis of the spool 4, to maintain a perpendicular relationship with the liner 12. While the block 78 is illustrated as a rectangular element, it would be appreciated that the longitudinal edges 84 of the block 78 may be smoothed down to more approximate a cylindrical or tubular configuration.

Mounted above the block 78 is at least one roll 86. Illustrated is a pair of rolls 86 mounted to side plates 88. The rolls 86 are mounted so that they freely rotate. These rolls 86 are employed when the strip component 10 is delivered to the spool 4 from the same side of the spool 4 as the liner 12 and guides the strip component 10 over the pre-former 32'. In such a delivery method, the liner 12 passes through the pre-former 32' while the strip component 10 travels above the pre-former 32'. For the embodiment illustrated in FIGS. 3–6, the strip component 10 may travel over the center roll 46, or the pre-former 32 may be provided with a separate roll, or other similar apparatus, mounted over the pre-former 32 to guide the strip component 10 over the pre-former 32.

The dual movement of the pre-former 32, 32' permits the liner 12 to be delivered to the spool 4 in a more consistent configuration as the liner 12 need not travel any extended distance where the arcuate configuration may be altered, and places less stress and tension on the liner 12. This increases the liner life, reducing manufacturing down time, and improves the accuracy of the placement of the strip component 10 laid upon the liner 12 which in turn improves the uniformity of the final manufactured product into which the strip component 10 is assembled. Also, the delivery system 8, and the pre-former 32, 32' is easier to load than conventional pre-formers due to the compact size. This also reduces the manufacturing down time, and increases the liner life.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full-intended scope of the invention as defined by the following appended claims.

What is claimed is:

1. An improved method for delivering a continuous strip material (12) to a spool (4) upon which it is wound, wherein the method includes the step of reducing the effective width of the continuous strip material (12) prior to its being wound on the spool (4) by shaping the strip material (12) into an arcuate cross-section with means (32, 32') rotatable about an axis (35) parallel with the axis of the spool (4), the improvement comprising:

moving the shaping means axis of rotation (35) in a vertical direction as needed while winding the strip material (12) on the spool (4) and maintaining the shaping means axis of rotation (35) parallel with the spool (4).

2. An improved method in accordance with claim 1 wherein the improvement is further characterized by the shaping means (32, 32') comprising multiple sets of rolls (36, 38, 40) that interact to reduce the effective width of the strip material (12).

3. An improved method in accordance with claim 2 wherein at least one of the sets of rolls (36) rotates about the axis of rotation of the shaping means (32, 32').

4. An improved method in accordance with claim 1 wherein the shaping means (32, 32') is comprised of an enclosed slot (80).

* * * * *